US007808167B2

(12) United States Patent
Fujii et al.

(10) Patent No.: US 7,808,167 B2
(45) Date of Patent: Oct. 5, 2010

(54) HIGH-PRESSURE DISCHARGE LAMP AND LIGHT SOURCES DEVICE USING THE SAME

(75) Inventors: Toshitaka Fujii, Himeji (JP); Atsuji Nakagawa, Himeji (JP); Hiroki Takahashi, Himeji (JP); Tomihiko Ikeda, Himeji (JP)

(73) Assignee: Phoenix Electric Co., Lt.d, Hyogo (JP)

( * ) Notice: Subject to any disclaimer, the term of this patent is extended or adjusted under 35 U.S.C. 154(b) by 328 days.

(21) Appl. No.: 12/071,446

(22) Filed: Feb. 21, 2008

(65) Prior Publication Data

US 2008/0297064 A1 Dec. 4, 2008

(30) Foreign Application Priority Data

May 28, 2007 (JP) ..... 2007-140685

(51) Int. Cl.
*H01J 1/00* (2006.01)

(52) U.S. Cl. ..... 313/260; 313/484

(58) Field of Classification Search ..... 313/634, 313/623, 260

See application file for complete search history.

(56) References Cited

U.S. PATENT DOCUMENTS 5,363,007 A * 11/1994 Fromm et al. ..... 313/25
6,713,963 B2 * 3/2004 Nakagawa ..... 313/623
7,038,384 B2 * 5/2006 Horiuchi et al. ..... 313/623
2006/0049764 A1 * 3/2006 Bedynek et al. ..... 313/637

* cited by examiner

*Primary Examiner*—Nimeshkumar D Patel
*Assistant Examiner*—Jacob Stern
(74) *Attorney, Agent, or Firm*—Kubotera & Associates LLC

(57) ABSTRACT

The high-pressure discharge lamp includes: a pre-seal glass inserted in the internal space of each of seal portions and integrally comprising a metal foil sheathing portion which sheathes a metal foil, an electrode sheathing portion which sheathes a portion of an electrode that extends from a first end of the metal foil toward a base portion and an external lead pin sheathing portion which sheathes a portion of an external lead pin that extends outwardly from the other end of the metal foil; and a conductor for generating discharge between the conductor and the metal foil. The electrode sheathing portion is fused to the base portion. The external lead pin sheathing portion has an outer surface hermetically fused to an inner surface of one of the seal portions. A clearance hermetically sealed between the pre-seal glass and the seal portion encapsulates inert gas therein.

12 Claims, 6 Drawing Sheets

HIGH-PRESSURE DISCHARGE LAMP AND LIGHT SOURCES DEVICE USING THE SAME

BACKGROUND OF THE INVENTION

1. Field of the Invention

The present invention relates to a high-pressure discharge lamp for a projector or the like, and a light source device using the high-pressure discharge lamp.

2. Description of the Related Art

A high-pressure discharge lamp for a light source of a projector or the like includes an arc tube portion encapsulating mercury vapor within an internal space thereof, and a pair of seal portions extending from both ends of the arc tube portion for sealing the internal space of the arc tube portion. The amount of light emitted from the high-pressure discharge lamp increases as the pressure of mercury vapor encapsulated in the arc tube portion increases. To emit a larger amount of light, it is required to raise the pressure of mercury vapor encapsulated in the arc tube portion. Therefore, an enhanced pressure tight performance is required for the seal portions.

In order to meet this requirement, the pressure tight performance of the seal portions has been enhanced as in a high-pressure discharge lamp 1 shown in FIG. 10, wherein metal foils 2 are embedded with respective pre-seal glasses 3; the pre-seal glasses 3 are embedded in respective seal portions 5 of a envelope 4 thereby enhancing the pressure tight performance of the seal portions 5 (see patent document 1: Japanese Patent Publication No. 2004-241375).

In the high-pressure discharge lamp 1, dielectric breakdown occurs between electrodes 6 by applying a high starting voltage between the electrodes 6. Mercury which is encapsulated in the arc tube portion 7 is excited by the arc which is generated by the dielectric breakdown and produces to emit light. The high-pressure discharge lamp 1 is difficult to start because such a high starting voltage is needed to be applied.

To start the high-pressure discharge lamp 1 easily with a low starting voltage, a space 8 is formed between the envelope 4 and the pre-seal glass 3 to encapsulate inert gas therein and a conductor 9 is placed to extend around the outer periphery of one of the seal portions 5 surrounding the space 8. To generate electric discharge between the metal foil 2 within the seal portion 5 and the conductor 9 for emitting ultraviolet rays, a high voltage is applied between the conductor 9 and the metal foil 2. The surface of the electrode 6 which is irradiated with the ultraviolet rays emits electrons to generate dielectric breakdown between the electrodes 6 easily, whereby the starting voltage for the high-pressure discharge lamp 1 can be lowered.

In the high-pressure discharge lamp 1 described in patent document 1, a material having a lower softening point than a material of the envelope 4 is forced to be used for the pre-seal glasses 3. Specifically, each of the metal foils 2 expands by heat used to heat-seal the envelope 4 and each pre-seal glass 3. Since the metal foil embedding portion of each pre-seal glass 3 wrapping the metal foil 2 is heat-sealed with the internal surface of the seal portion 5, a stress produced with expansion of the metal foil 2 reaches to the heat-sealed portion between the pre-seal glass 3 and the seal portion 5. And the stress causes cracking which might result in leakage of mercury vapor encapsulated within the internal space of the arc tube portion 7. To obviate this problem, the high-pressure discharge lamp 1 described in patent document 1 imparts the seal portions 5 with an enhanced pressure tight performance by employing the material having a lower softening point than the material of the envelope 4 for the pre-seal glasses 3 and embedding each pre-seal glass 3 in respective the seal portions 5 of the envelope 4 under compression stress. The compression stress exerted on the pre-seal glass 3 acts to suppress the stress produced with expansion of the metal foil 2 thereby preventing from cracking.

However, use of different materials for the envelope 4 and the pre-seal glass 3 results in disadvantages including: an increase in the cost of manufacturing the high-pressure discharge lamp 1; an increase in the man-hour required for the manufacture of the high-pressure discharge lamp 1; and a decrease in the stability of raw glass material supply. In addition, the envelope 4 and the pre-seal glass 3 are formed from different materials so that thermal expansion coefficients are naturally different from each other. For this reason, the difference in thermal expansion coefficients might cause cracking at the heat-sealed interface between the envelope 4 and the pre-seal glass 3 as the high-pressure discharge lamp 1 is turned on and off repeatedly.

Though the above-described technique makes it possible to start lighting the lamp at a starting voltage that is lowered to a certain degree, a high-pressure discharge lamp which can be started at a lower starting voltage has been required.

SUMMARY OF THE INVENTION

According to a first aspect of the present invention, there is provided a high-pressure discharge lamp comprising:

a luminescent material;

an envelope including an arc tube portion having a first internal space in which the luminescent material is encapsulated, a pair of seal portions respectively extending from opposite ends of the arc tube portion and having second internal spaces, and a pair of base portions provided at borders of the seal portions for isolating the first internal space and the second internal spaces;

a mount inserted in the second internal space of one of the seal portions, the mount including a metal foil, an electrode having one end protruding into the first internal space and the other end connected to one end of the metal foil through one of the base portions, an external lead pin having one end connected to the other end of the metal foil and the other end protruding outside of the one of the seal portions, and a pre-seal glass embedded in the second internal space of the one of the seal portions, the pre-seal glass including a metal foil sheathing portion in which the metal foil is sheathed, an electrode sheathing portion sheathing a portion of the electrode extending from the one end of the metal foil toward the one of the base portions and fused to the one of the base portions, and an external lead pin sheathing portion sheathing a portion of the external lead pin extending outwardly from the other end of the metal foil and hermetically fused to an internal surface of the one of the seal portions, and a clearance defined between the metal foil sheathing portion and the one of the seal portions;

a conductor arranged around an outer periphery of the one of the seal portions for generating discharge between the conductor and the metal foil; and an inert gas encapsulated in the clearance hermetically sealed between the electrode sheathing portion and the external lead pin sheathing portion.

In the high-pressure discharge lamp according to the present invention, the electrode sheathing portion of the pre-seal glass which sheathes a portion of the electrode that extends from the one end of the metal foil toward the one of the base portions is fused to the one of the base portions of the envelope and the external lead pin sheathing portion which sheathes a portion of the external lead pin that extends outwardly from the other end of the metal foil is hermetically fused to an inner peripheral surface of the one of the seal portions. That is, the pre-seal glass is fused to the envelope at locations clear of the metal foil sheathing portion which sheathes the metal foil so that the metal foil sheathing portion of the pre-seal glass is not fused to the inner surface of the one of the seal portions. Therefore, the metal foil is not directly subjected to heat for fusing the pre-seal glass to the one of the base portions and to the one of the seal portions.

As compared to the conventional art described in patent document 1, the metal foil is heated with a remarkably lowered calorie and hence expands to a small extent. Since the expansion of the metal foil is small, the stress exerted on the pre-seal glass by the expansion of the metal foil is low. Further, the stress produced by the expansion of the metal foil is exerted only on the metal foil sheathing portion of the pre-seal glass and, hence, the electrode sheathing portion and the external lead pin sheathing portion of the pre-seal glass are not subjected to the stress produced by the expansion of the metal foil.

Thus, it is possible to prevent from cracking at the fused portions between the envelope and the pre-seal glass due to the stress exerted by the metal foil.

Since the electrode sheathing portion and external lead pin sheathing portion of the pre-seal glass are located at end portions of the pre-seal glass, it is possible to maximize the volume of the clearance defined between the outer surface of the pre-seal glass and the inner surface of the one of the seal portions. The clearance having a maximized volume can encapsulate an increased amount of the inert gas therein. With increasing the amount of the inert gas, the amount of ultraviolet rays produced by discharge between the metal foil and the conductor increases. The increase of the amount of ultraviolet rays enables to generate dielectric breakdown easily between the electrodes thereby making the starting voltage lower than that required for the conventional high-pressure discharge lamp.

In an embodiment of the high-pressure discharge lamp according to the present invention, the inert gas encapsulated within the clearance may contain neon gas.

Argon gas is generally used as the inert gas to be encapsulated in the first internal space and in the clearance. Using the inert gas containing neon gas which is lower in dielectric breakdown voltage than argon gas enables to lower the starting voltage of discharge between the conductor and the metal foil.

In another embodiment of the high-pressure discharge lamp according to the present invention, the clearance may encapsulate therein mercury vapor in addition to the inert gas.

Mercury vapor can cooperate with the inert gas to exercise Penning effect, thereby making it possible to lower the starting voltage of discharge between the conductor and the metal foil. Accordingly, mercury vapor encapsulated in the clearance together with the inert gas enables to lower the starting voltage of discharge between the conductor and the metal foil.

In another embodiment of the high-pressure discharge lamp according to the present invention, a metal piece may be arranged in the clearance.

In the high-pressure discharge lamp according to the first aspect of the present invention, the one of the seal portions of the envelope intervenes between the conductor and the inert gas. And the pre-seal glass intervenes between the inert gas and the metal foil. That is, an electrodeless structure is formed in which the conductor and the inert gas are isolated from each other while the inert gas and the metal foil isolated from each other. In such the electrodeless structure, the provision of the metal piece in the clearance increases the electrostatic capacity between the conductor and the metal foil, and that enables electricity to pass between the conductor and the metal foil easily. For this reason, the starting voltage of discharge between the conductor and the metal foil can be further lowered.

In another embodiment of the high-pressure discharge lamp according to the present invention, the metal piece may be formed of a metal wire wound around an outer periphery of the pre-seal glass within the clearance.

Using the metal wire as the metal piece causes the electrostatic capacity between the conductor and the metal foil to be strengthened, thereby lowering the starting voltage of discharge between the conductor and the metal foil. In addition, the metal wire can be easily fixed to the pre-seal glass by being wound around the outer periphery of the pre-seal glass. For this reason, the metal wire is not displaced undesirably during the sealing operation performed in the manufacture of the high-pressure discharge lamp. Thus, the high-pressure discharge lamp can be manufactured easily.

In another embodiment of the high-pressure discharge lamp according to the present invention, the conductor may be formed of a metal wire.

The metal wire used as the conductor can be easily fixed by being wound around the outer periphery of the one of the seal portions. Therefore, the metal wire keeps from being undesirably displaced from the outer periphery of the one of the seal portions. Also, the conductor can be made with a same metal wire as a trigger wire which is generally used to improve the starting property of a high-pressure discharge lamp.

In another embodiment of the high-pressure discharge lamp according to the present invention, the conductor may be a conductive coat formed over an outer surface of the one of the seal portions.

Using the conductive coat formed over the outer surface of the one of the seal portions as the conductor enables to make discharge area larger than the use of, for example, a metal wire as the conductor. For this reason, discharge between the conductive coat and the metal foil is allowed to be generated easily. That enables to improve the starting property of the high-pressure discharge lamp.

Since the conductive coat is a film formed over the outer surface of the one of the seal portions, the conductive coat does not protrude from the outer surface of the one of the seal portions, unlike the conductor shaped into a wire. Therefore, in adjusting the focal point after the high-pressure discharge lamp has been fitted in a reflector having an access hole for receiving the one of the seal portions of the high-pressure discharge lamp, the conductive coat does not interfere with an internal surface of the access hole, thus allowing the focal point adjustment to be achieved easily.

In another embodiment of the high-pressure discharge lamp according to the present invention, the pre-seal glass embedded in the second internal space of the one of the seal portions may include a through hole for bringing the inert gas encapsulated in the clearance into contact with the metal foil.

In the high-pressure discharge lamp according to this embodiment, a one-electrode structure is formed in which the inert gas is brought into contact with the metal foil through the through hole while the conductor is isolated from the inert gas. For this reason, as compared to any one of the foregoing embodiments formed with the electrodeless structure, this embodiment formed with the one-electrode structure has a larger electrostatic capacity between the conductor and the metal foil, hence, a stronger capacitive coupling therebetween. Thus, the starting voltage of discharge between the conductor and the metal foil can be further lowered.

Since the through hole is formed at the metal foil sheathing portion of the pre-seal glass so as to bring the inert gas into contact with the metal foil, the provision of the through hole did not exert any influence on the electrode sheathing portion or the external lead pin sheathing portion of the pre-seal glass. Thus, the pressure tight performance of the high-pressure discharge lamp will not be lowered. Therefore, this embodiment enables to improve the starting property while maintaining the pressure tight performance of the high-pressure discharge lamp.

In another embodiment of the high-pressure discharge lamp according to the present invention, the pre-seal glass may be formed of a quartz glass having a high dielectric constant.

Using quartz glass having a high dielectric constant for the pre-seal glass increases the electrostatic capacity between the conductor and the metal foil, which causes the electrostatic capacity therebetween to be strengthened. Accordingly, the starting voltage of discharge between the conductor and the metal foil can be further lowered.

According to a second aspect of the present invention, there is provided a high-pressure discharge lamp comprising:

a luminescent material;

an envelope including an arc tube portion having a first internal space in which the luminescent material is encapsulated, a pair of seal portions respectively extending from opposite ends of the arc tube portion and having second internal spaces, and a pair of base portions provided at borders of the seal portions for isolating the first internal space and the second internal spaces;

a mount inserted in the second internal space of one of the seal portions, the mount including a first metal foil, an electrode having one end protruding into the first internal space and the other end connected to one end of the first metal foil through one of the base portions, a first external lead pin having one end connected to the other end of the first metal foil and the other end protruding outside of the one of the seal portions, and a pre-seal glass embedded in the second internal space of the one of the seal portions, the pre-seal glass including a metal foil sheathing portion in which the first metal foil is sheathed, an electrode sheathing portion sheathing a portion of the electrode extending from the one end of the first metal foil toward the one of the base portions and fused to the one of the base portions, and an external lead pin sheathing portion sheathing a portion of the first external lead pin extending outwardly from the other end of the first metal foil and hermetically fused to an internal surface of the one of the seal portions, and a clearance defined between the metal foil sheathing portion and the one of the seal portions;

a conductor wound around an outer surface of the pre-seal glass within the clearance for generating discharge between the conductor and the first metal foil;

an inert gas encapsulated in the clearance hermetically sealed between the electrode sheathing portion and the external lead pin sheathing portion;

a second metal foil embedded in a fused portion between the one of the seal portions and the external pin sheathing portion, the second metal foil having one end connected to the conductor; and a second external lead pin having one end connected to the other end of the second metal foil and the other end protruding outside through the one of the seal portions.

The high-pressure discharge lamp according to the second aspect of the present invention can offer all the advantages of the high-pressure discharge lamp according to the first aspect of the present invention. In addition, the high-pressure discharge lamp according to the second aspect of the present invention is formed with a one-electrode structure in which the inert gas is in contact with the conductor while the first metal foil is isolated from the inert gas. For this reason, as compared to the high-pressure discharge lamp formed with the electrodeless structure, the high-pressure discharge lamp formed with the one-electrode structure has a larger electrostatic capacity between the conductor and the first metal foil, hence, a stronger capacitive coupling therebetween. Thus, the starting voltage of discharge between the conductor and the first metal foil can be further lowered.

Since the conductor is arranged in the clearance between the one of the seal portions and the pre-seal glass, the conductor does not protrude from the outer surface of the one of the seal portions. Therefore, in adjusting the focal point after the high-pressure discharge lamp has been fitted in a reflector having an access hole for receiving the one of the seal portions of the high-pressure discharge lamp, the conductor does not interfere with an internal surface of the access hole as in the foregoing embodiment having the conductive coat, thus allowing the focal point adjustment to be achieved easily.

According to a third aspect of the present invention, there is provided a light source device comprising: any one of the high-pressure discharge lamps described above; and a high-frequency starter for applying a high voltage having a high frequency between the external lead pin (the first external lead pin) and the conductor of the high-pressure discharge lamp.

The high-pressure discharge lamp according to the present invention prevents from cracking at the fused portion between the envelope and the pre-seal glass. Accordingly, the high-pressure discharge lamp exhibits such a high pressure tight performance so as to enable the luminescent material to be encapsulated in the first internal space at a very high pressure by using the same kind of material for the envelope and the pre-seal glass. Also, the high-pressure discharge lamp can produce an increased amount of ultraviolet rays by discharge between the metal foil and the conductor, thereby lowering the starting voltage for the high-pressure discharge lamp.

The foregoing and other objects, features and attendant advantages of the present invention will become apparent from the following detailed description taken in connection with the accompanying drawings.

DETAILED DESCRIPTION OF THE PREFERRED EMBODIMENTS

The present invention will now be described in detail with reference to the accompanying drawings.

First Embodiment

Figure 1:
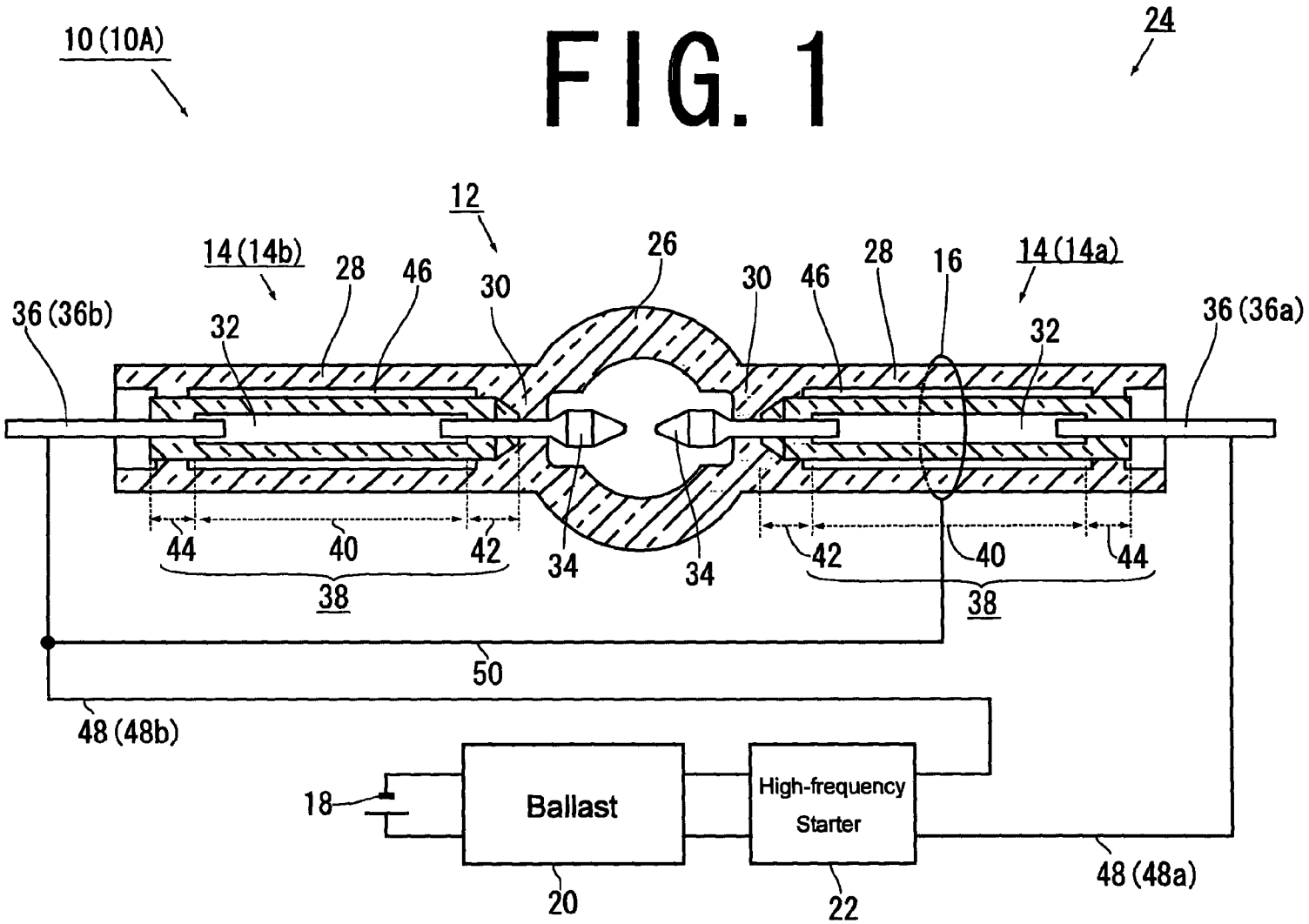
FIG. 1 is a view of a light source device using a high-pressure discharge lamp in accordance with a first embodiment of the present invention.

FIG. 1 is a sectional view showing a high-pressure discharge lamp 10A of the double-ended type according to a first embodiment of the present invention. While the present invention is, of course, applicable to high-pressure discharge lamps of the single-ended type, description is herein made of the double-ended type high-pressure discharge lamp as a typical high-pressure discharge lamp to which the invention is applicable.

The high-pressure discharge lamp 10A in accordance with the present invention generally comprises an envelope 12, a pair of mounts 14 embedded in the envelope 12, and a conductor 16. The high-pressure discharge lamp 10A is combined with a d.c. power source 18, a ballast 20 and a high-frequency starter 22 to form a light source device 24.

The envelope 12 includes a substantially spherical arc tube portion 26 having a first internal space, a pair of seal portions 28 extending from opposite sides of the arc tube portion 26 and having second internal spaces, and a pair of base portions 30 provided at borders of the seal portions for isolating the first internal space from the second internal spaces. The envelope 12 is formed from quartz glass, which can hardly expand and shrink thermally. The meaning of "isolating" is to prevent a luminescent material encapsulated in the arc tube portion 26 from leaking to the second internal spaces.

The arc tube portion 26 encapsulates the luminescent material (inert gas and mercury vapor) within its first internal space at a high pressure. The arc tube portion 26 emits light by generating discharge following dielectric breakdown between opposed tips of electrodes 34 (to be described later) spaced part from each other in the first internal space.

The mounts 14 embedded in each of the seal portions 28. One mount 14*a* includes a metal foil 32 formed of molybdenum, a tungsten electrode 34 extending through one of the base portions 30 and having one end protruding into the first internal space and the other end connected to one end of the metal foil 32, an external lead pin 36 having one end connected to the other end of the metal foil 32, and the other end protruding outside of one of the seal portions 28, and a pre-seal glass 38. In the case of the high-pressure discharge lamp 10 adapted to a.c. lighting, the opposed end portions of the electrodes 34 which are located within the arc tube portion 26 have substantially the same shape. In the case of the high-pressure discharge lamp 10 adapted to d.c. lighting, in contrast, the electrode used as the anode is larger than the electrode used as the cathode.

The other mount 14*b* includes the same as the one mount 14*a*. So each parts comprised the one mount 14*a* are only explained.

The pre-seal glass 38 which sheathe the metal foil 32 within the second internal space of the one of the seal portions 28, integrally comprises a metal foil sheathing portion 40 sheathing the metal foil 32, an electrode sheathing portion 42 sheathing a portion of the electrode 34 that extends from the one end of the metal foil 32 toward the one of the base portions 30, and an external lead pin sheathing portion 44 sheathing a portion of the external lead pin 36 that extends outwardly from the other end of the metal foil 32. The electrode sheathing portion 42 of the pre-seal glass 38 has an electrode-side end portion shaped into a truncated cone. The pre-seal glass 38 comprises quarts glass of the same material as the material of the envelope 12.

The pre-seal glass 38 has a smaller diameter than the second internal space of the one of the seal portions 28 so that a clearance 46 is defined between an outer surface of the metal foil sheathing portion 40 and an inner surface of the one of the seal portions 28 of the envelope 12. The electrode sheathing portion 42 of the pre-seal glass 38 is fused to the one of the base portions 30 of the envelope 12. And the external lead pin sheathing portion 44 has an outer surface hermetically fused to the inner surface of the one of the seal portions 28. The meaning of "hermetically fused" is to fuse all over the outer surface of the external lead pin sheathing portion 44 to the inner surface of the one of the seal portions 28 steadily. Thus, the clearance 46 is hermetically sealed between the electrode sheathing portion 42 and the external lead pin sheathing portion 44. The clearance 46 will be referred to as "hermetical cavity 46". Argon gas which is an inert gas is encapsulated in the hermetical cavity 46.

The conductor 16 is a ring-shaped metal wire extending around the outer periphery of the one of the seal portions 28 that surrounds the hermetical cavity 46. No conductor 16 is set around the outer periphery of the other of the seal portions 28.

The ballast 20 is a circuit supplied with a voltage from the d.c. power source 18 for stably applying the pair of electrodes 34 with a fixed a.c. power required for the high-pressure discharge lamp 10A to light in spite of fluctuations in the voltage supplied to the high-pressure discharge lamp 10A against variations in voltage with time, or the like. The ballast 20 is electrically connected to one external lead pin 36*a* arranged in the one mount 14*a* associated with the conductor 16 and to the other external lead pin 36*b* arranged in the other mount 14*b* through respective conductive wires 48*a* and 48*b* via the high-frequency starter 22. Also, one end of a conductor wire 50 is electrically connected to the conductor 16 and the other end of the conductor wire 50 is electrically connected to the conductor wire 48*b* which electrically interconnects the ballast 20 and the other external lead pin 36*b*.

The high-frequency starter 22 is a circuit for raising the frequency of the voltage inputted from the ballast 20 and supplying the voltage to the high-pressure discharge lamp 10A so as to generate dielectric breakdown easily between the pair of electrodes 34, and between the metal foil 32 and the conductor 16. The metal foil 32 and the conductor 16 which are not directly connected to each other form a sort of capacitor by capacitive coupling therebetween. Capacitors generally allow current to pass therethrough more easily as the frequency of the applied voltage increases. Accordingly, by raising the frequency of the voltage to be supplied to start lighting the high-pressure discharge lamp 10A, current can pass between the pair of electrodes 34 and between the metal foil 32 and the conductor 16 easily. Therefore, dielectric breakdown can be generated easily.

High-Pressure Discharge Lamp Manufacturing Procedure

Figure 2:
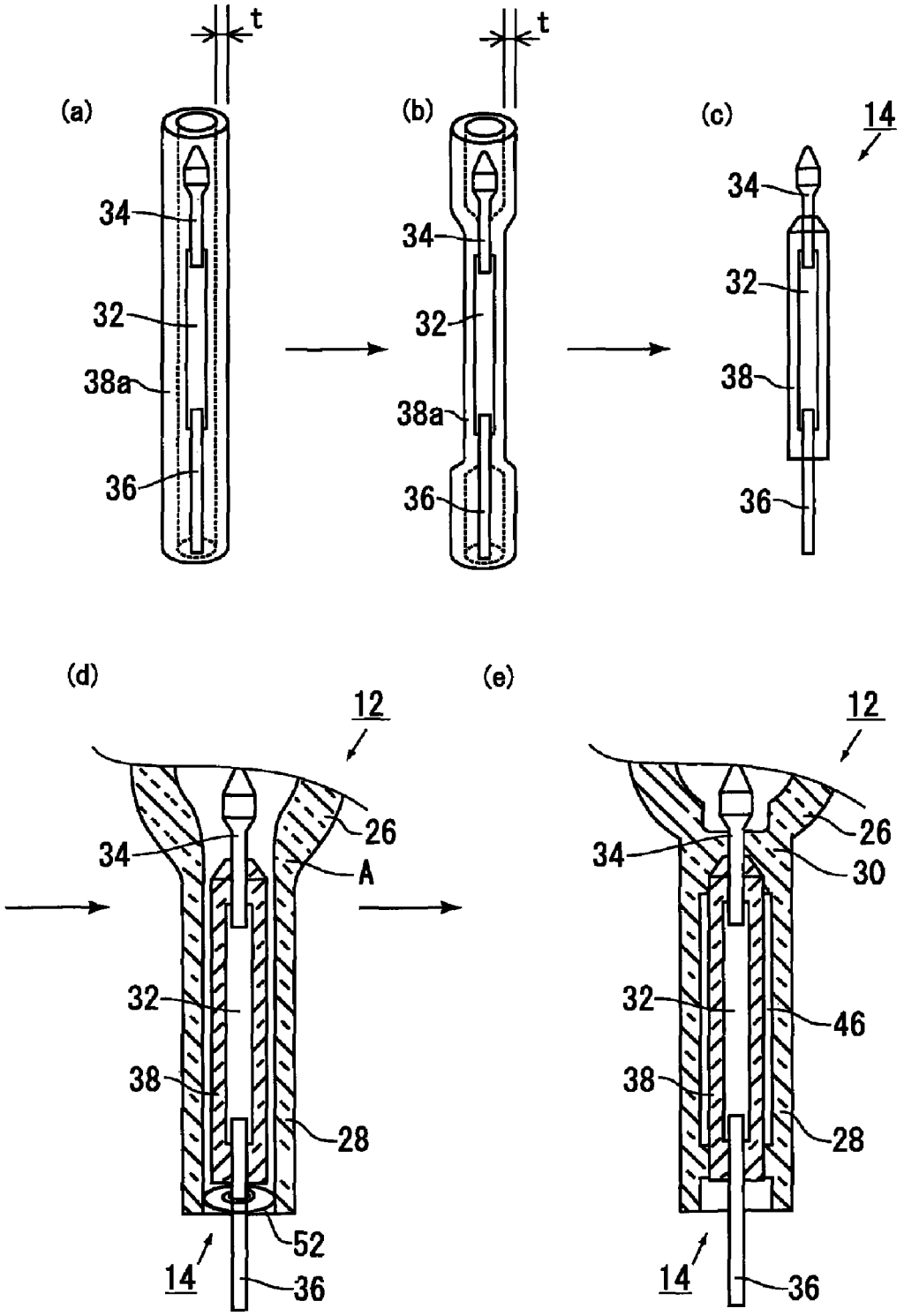
FIG. 2 is a view of a procedure for manufacturing the high-pressure discharge lamp in accordance with the first embodiment of the present invention.

Referring to FIG. 2, the manufacturing procedure includes sequential procedural steps (a) to (e). In the step (a), the other end of one electrode 34 is spot-welded to the one end of the metal foil 32; subsequently, the one end of the external lead pin 36 is spot-welded to the other end of the metal foil 32; and the assembly (electrode 34-metal foil 32-external lead pin 36) thus formed is inserted into a pre-seal glass tube 38*a* having a wall thickness of 0.5 to 0.8 mm. In the step (b), the pre-seal glass tube 38*a* is thermally shrunk by heating at not lower than 2,000 Ž, because the softening point of quartz glass is about 1,650 Ž. In the step (c), the pre-seal glass tube 38*a* thus shrunk is cut at predetermined positions to form the pre-seal glass 38 of a substantially columnar shape, thus forming the one mount 14. In this case the pre-seal glass 38 having a smaller wall thickness "t" requires a shorter heating time. Thus, the use of the pre-seal glass 38 having a small thickness enables to lower the possibility that the pre-seal glass 38 falls off the surface of the metal foil 32 due to the difference in thermal expansion coefficient between the pre-seal glass 38 and the metal foil 32.

In the step (d), the one mount 14 is inserted into the one of the seal portions 28 of the envelope 12 (not yet formed with the both base portions 30 at this step) and then positioned in the second internal space of the one of the seal portions 28 by utilizing the elasticity of a ring 52 provisionally attached to the external lead pin extending outwardly from the mount 14. In the step (e), with the one mount 14 in this condition, while the envelope 12 is in a vacuum, a joint portion A (corresponding to the one of the base portions 30 in the completed product) between the arc tube portion 26 and the one of the seal portions 28 is heated in inert gas atmosphere at not lower than 2,000 Ž for 10 to 12 seconds for example so as the joint portion A to shrink. By the step (e), the one of the base portions 30 is formed so as to isolate the first internal space and the second internal space of the one of the seal portions 28 from each other and the electrode sheathing portion 42 of the pre-seal glass 38 fused to the one of the base portions 30. Instead of the above described shrink sealing process, a pinch sealing process (pinching the envelope 12 in a heated condition) may be applied.

Then, argon gas is supplied into the space (hermetical cavity 46) defined between the inner surface of the one of the seal portions 28 and the outer surface of the pre-seal glass 38. Thereafter, a portion of the one of the seal portions 28 is heated from outside at not lower than 2,000 Ž for 10 to 12 seconds for example, to fuse the inner surface of the one of the seal portions 28 to the outer surface of the external lead pin sheathing portion 44. Then, the space is hermetically sealed and the hermetical cavity 46 is formed and at the same time the embedding of the one mount 14 in the one of the seal portions 28 completed. The pinch sealing process may be applied to form the hermetical cavity 46.

After the one mount 14 has been thus embedded in the one of the seal portions 28, required substances to be encapsulated including the inert gas, mercury and other substances are encapsulated in the first internal space. Subsequently, the other mount 14 is embedded in the other of the seal portions 28 by the same procedure as described above.

In the high-pressure discharge lamp 10A according to the present embodiment, the electrode sheathing portion 42 of the pre-seal glass 38 which sheathes a portion of the electrode 34 that extends from the one end of the metal foil 32 toward the one of the base portions 30 is fused to the base portion 30 of the envelope 12. And the external lead pin sheathing portion 44 which sheathes a portion of the external lead pin that extends outwardly from the other end of the metal foil 32 is hermetically fused to the inner surface of the one of the seal portions 28. That is, the pre-seal glass 38 is fused to the envelope 12 at locations clear of the metal foil sheathing portion 40 sheathing the metal foil 32, while the metal foil sheathing portion 40 of the pre-seal glass 38 is not fused to the inner surface of the one of the seal portions 28. Therefore, the metal foil 32 is not directly subjected to heat for fusing the pre-seal glass 38 to the one of the base portions 30 and to the one of the seal portions 28.

As compared to the conventional art, the metal foil 32 is subjected to heat of a remarkably lowered calorie and, hence, the metal foil 32 expands to a small extent. Since the expansion of the metal foil 32 is small, the stress exerted on the pre-seal glass 38 by the expansion of the metal foil 32 is small. Further, the stress produced by the expansion of the metal foil 32 is exerted only on the metal foil sheathing portion 40 of the pre-seal glass 38 and, hence, neither the electrode sheathing portion 42 nor the external lead pin sheathing portion 44 of the pre-seal glass 38 is subjected to the stress. Thus, it is possible to prevent from cracking at the fused portions between the envelope 12 and the pre-seal glass 38 due to the stress exerted by the metal foil 32. Therefore, the high-pressure discharge lamp 10A exhibits such a high pressure tight performance so as to enable the arc tube portion 26 to encapsulate the luminescent material in the first internal space thereof at a very high pressure by using the same material for the envelope 12 and the pre-seal glass 38.

Further, the metal wire used as the conductor 16 can be easily fixed to the one of the seal portions 28 by being wound around the outer periphery of the one of the seal portions 28. For this reason, the metal wire as the conductor 16 keeps from being undesirably displaced from the outer periphery of the one of the seal portions 28. Also, the conductor 16 can be made with a same metal wire as a trigger wire (not shown) which is generally used to improve the starting property of a high-pressure discharge lamp.

High-Pressure Discharge Lamp Lighting Procedure

Description will be made of the procedure for lighting the high-pressure discharge lamp 10A according to the present embodiment with reference to FIG. 1. The d.c. power source 18, ballast 20 and high-frequency starter 22 cooperate to generate a high voltage having a high frequency and apply the resulting high voltage between the pair electrodes 34 through the conductive wires 48, external lead pins 36 and metal foils 32. The high voltage is also applied between the conductor 16 and the metal foil 32 of the one mount 14*a* through the conductive wire for conductor 50. Then dielectric breakdown is generated between the metal foil 32 and the conductor 16 at a voltage that is lower than the voltage at which dielectric breakdown is generated between the pair of electrodes 34 and higher than the dielectric breakdown voltage of argon gas, with the result that ultraviolet rays are emitted from argon gas. Resulting ultraviolet rays are transmitted to the arc tube portion 26 through the one of the seal portions 28 of the envelope 12 (by the so-called optical fiber effect) and then guided into the first internal space, thus causing the electrodes 34 to emit electrons. The emission of electrons induces dielectric breakdown between the electrodes 34 at a starting voltage that is far lower than that required for high-pressure discharge lamps of the type which is not configured to utilize such emission of ultraviolet rays. Thus, the high-pressure discharge lamp 10A can start lighting at a lower starting voltage than high-pressure discharge lamps of the type not provided with the conductor 16 or the hermetical cavity 46.

Further, the electrode sheathing portion 42 and the external lead pin sheathing portion 44 of the pre-seal glass 38 are located at the opposite ends of the pre-seal glass 38. Accordingly, it is possible to maximize the volume of the hermetical cavity 46 defined between the outer surface of the pre-seal glass 38 and the inner surface of the one seal portion 28. The hermetical cavity 46 having a maximized volume can encapsulate a larger amount of the inert gas therein. With increasing amount of the inert gas, the amount of ultraviolet rays produced by discharge between the metal foil 32 and the conductor 16 increases. That facilitates the dielectric breakdown between the electrodes 34 thereby making the starting voltage lower than that required for the conventional high-pressure discharge lamp.

In the case of the high-pressure discharge lamp 10A according to the present embodiment, the starting voltage required is not higher than 2 kV when the lamp 10A is in a cooled condition. This means that the high-pressure discharge lamp 10A can be started at a voltage that is remarkably lower than a starting voltage of 10 to 15 kV required for high-pressure discharge lamps of the conventional type which is not provided with the hermetical cavity 46 and the conductor 16. In addition, since the high-pressure discharge lamp 10A can be started at the starting voltage as low as or lower than 2 kV, the high-pressure discharge lamp 10A can reduce noise which is produced during the starting phase.

Second Embodiment

Description will be made of a second embodiment (high-pressure discharge lamp 10B) of the present invention with reference to FIG. 3. The second embodiment is different from the foregoing first embodiment in that a metal piece 54 is placed in the hermetical cavity 46. For this reason, the following description is directed mainly to the features related to the metal piece 54. Other features and advantages of the second embodiment which are like the corresponding features and advantages of the first embodiment will be mentioned by reference to the description of the first embodiment.

In the present embodiment, the metal piece 54 placed in the hermetical cavity 46 is a heat-resistant metal foil wrapping around the metal foil sheathing portion 40 of the pre-seal glass 38. The metal piece 54 is formed of molybdenum.

In the high-pressure discharge lamp 10A according to the first embodiment, the one of the seal portions 28 intervenes between the conductor 16 and the inert gas. And the pre-seal glass 38 intervenes between the inert gas and the metal foil 32. That is, the high-pressure discharge lamp 10A (the first embodiment) is formed with the electrodeless structure in which the conductor 16 and the metal foil 32 are both isolated from the inert gas. With the electrodeless structure, the provision of the metal piece 54 in the hermetical cavity 46 increases the electrostatic capacity between the conductor 16 and the metal foil 32. Capacitors generally allow current to pass more easily as the electrostatic capacity thereof increases. Accordingly, by increasing the electrostatic capacity between the conductor 16 and the metal foil 32, it is possible to lower the starting voltage of discharge between the metal foil 32 and the conductor 16.

Figure 3:
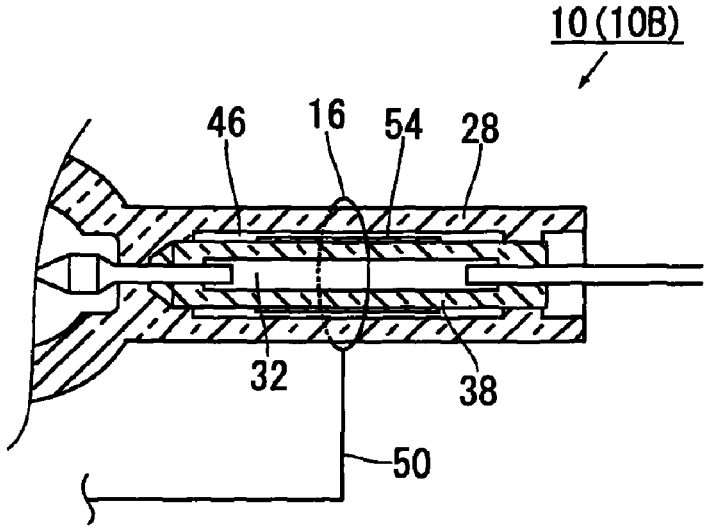
FIG. 3 is a view of a high-pressure discharge lamp in accordance with a second embodiment of the present invention.
Figure 4:
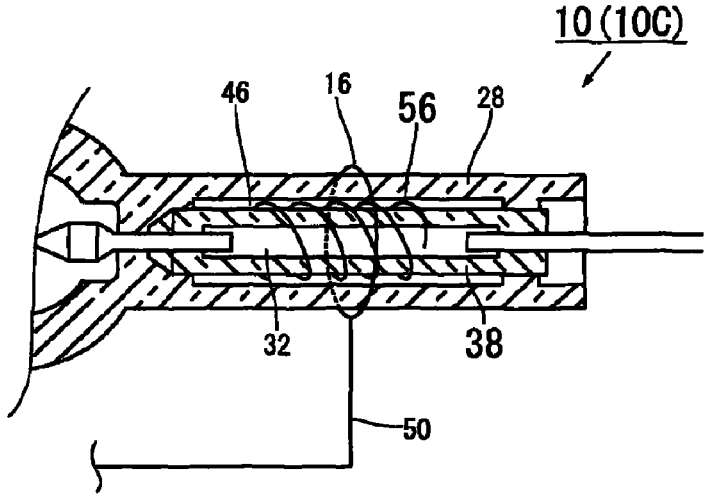
FIG. 4 is a view of a high-pressure discharge lamp in accordance with a variation of the second embodiment.

The metal piece 54 used in the present embodiment is not limited to a metal foil as shown in FIG. 3. For example, the metal piece 54 may be used a metal wire 56 as used in a high-pressure discharge lamp 10C shown in FIG. 4. In addition to the above-described advantage, the use of such a metal wire 56 will bring the advantage that the metal wire 56 can be easily fixed to the pre-seal glass 38 by being wound around the outer periphery of the pre-seal glass 38. For this reason, the metal wire 56 is not displaced undesirably during the sealing in the manufacture of the high-pressure discharge lamp 10C. Thus, the high-pressure discharge lamp 10C can be manufactured easily.

Third Embodiment

Figure 5:
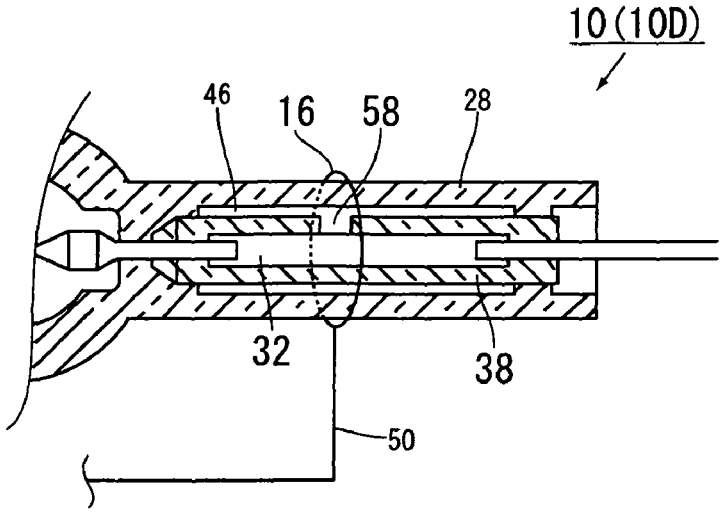
FIG. 5 is a view of a high-pressure discharge lamp in accordance with a third embodiment of the present invention.

Description will be made of a third embodiment (high-pressure discharge lamp 10D) of the present invention with reference to FIG. 5. The third embodiment is different from the foregoing first embodiment in that the metal foil sheathing portion 40 of the pre-seal glass 38 includes a through hole 58 through which the inert gas encapsulated in the hermetical cavity 46 is brought into contact with the metal foil 32. For this reason, the following description is directed mainly to the features related to the through hole 58. Other features and advantages of the third embodiment which are like the corresponding features and advantages of the first embodiment will be mentioned by reference to the description of the first embodiment.

The high-pressure discharge lamp 10D according to the present embodiment is formed with a one-electrode structure in which the inert gas is brought into with the metal foil 32 through the through hole 58 while the conductor 16 isolated from the inert gas. As compared to the high-pressure discharge lamp formed with the electrodeless structure, the high-pressure discharge lamp 10D formed with the one-electrode structure has a larger electrostatic capacity between the conductor 16 and the metal foil 32, hence, a stronger capacitive coupling therebetween. Thus, the starting voltage of discharge between the conductor 16 and the metal foil 32 can be further lowered. Also, the provision of the through hole 58 does not exert any influence on the electrode sheathing portion 42 or the external lead pin sheathing portion 44 of the pre-seal glass 38. Thus, the pressure tight performance of the high-pressure discharge lamp 10D will not be lowered. Therefore, the present embodiment is capable of improving the starting property while maintaining the pressure resistance of the high-pressure discharge lamp 10D.

Fourth Embodiment

Figure 6:
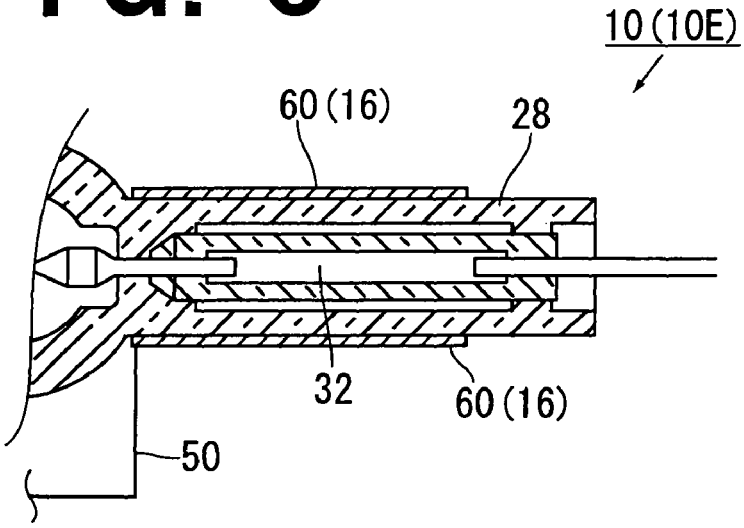
FIG. 6 is a view of a high-pressure discharge lamp in accordance with a fourth embodiment of the present invention.

Description will be made of a fourth embodiment (high-pressure discharge lamp 10E) of the present invention with reference to FIG. 6. The fourth embodiment is different from the foregoing first embodiment in that the conductor 16 comprises a conductive coat 60 formed over an outer surface of the one of the seal portions 28. For this reason, the following description is directed mainly to the features related to the conductive coat 60. Other features and advantages of the fourth embodiment which are like the corresponding features and advantages of the first embodiment will be mentioned by reference to the description of the first embodiment.

In the high-pressure discharge lamp 10E according to the present embodiment, the conductive coat 60 is formed over the outer surface of the one of the seal portions 28. And a conductor wire for conductor 50 electrically connected to the conductive coat 60.

The use of the conductive coat 60 formed over the outer surface of the one of the seal portions 28 as the conductor 16 enables to provide a larger discharge area than the use of, for example, a metal wire as the conductor 16. For this reason, discharge between the conductive coat 60 and the metal foil 32 is generated easily and, hence, it is possible to improve the starting property of the high-pressure discharge lamp 10E.

Figure 7:
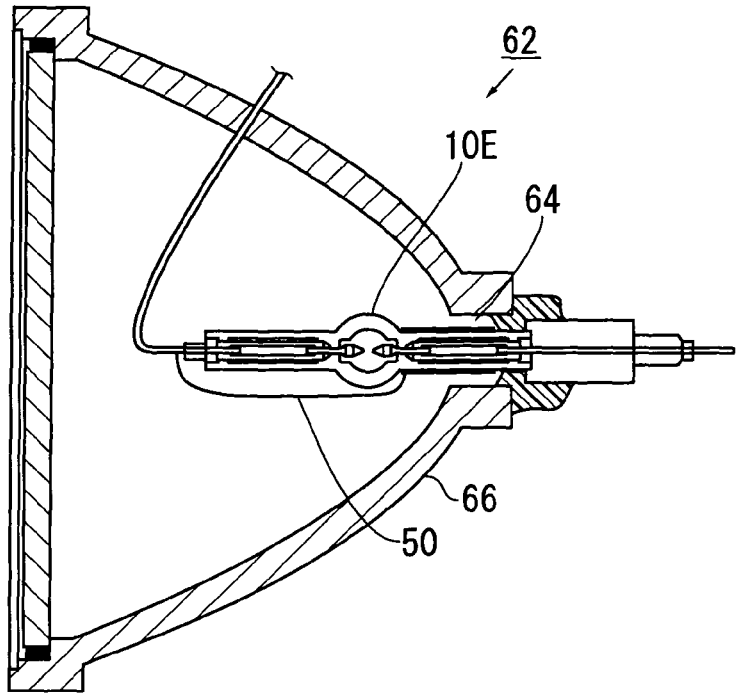
FIG. 7 is a view of the high-pressure discharge lamp in accordance with the fourth embodiment in a condition fitted in a reflector.

Since the conductive coat 60 is a film formed over the outer surface of the one of the seal portions 28, the conductive coat 60 does not protrude from the outer surface of the one of the seal portions 28, unlike using the conductive wire as the conductor 16. In assembling a lamp 62 including the high-pressure discharge lamp 10E as shown in FIG. 7 for example, an operation is necessary which includes fitting the high-pressure discharge lamp 10E on a reflector 66 having an access hole 64 for receiving the one of the seal portions 28 of the high-pressure discharge lamp 10E and then adjusting the positional relation between the high-pressure discharge lamp 10E and the reflector 66 to adjust the focal point. At that time, if the conductor 16 comprising a metal wire is wound around the one of the seal portions 28, the metal wire interfere with the internal surface of the access hole 64 thereby hindering the focal point adjusting operation. In contrast, the high-pressure discharge lamp 10E according to the present embodiment has not such an interfering member like the metal wire but the conductive coat 60 formed over the outer surface of the one of the seal portions 28. Thus, the high-pressure discharge lamp 10E according to the present embodiment allows the focal point adjustment to be achieved easily after having been fitted on the reflector 66.

Fifth Embodiment

Figure 8:
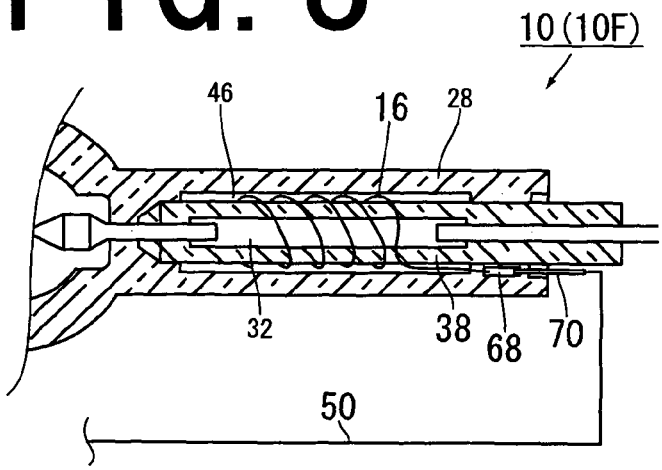
FIG. 8 is a view of a high-pressure discharge lamp in accordance with a fifth embodiment of the present invention.

Description will be made of a fifth embodiment (high-pressure discharge lamp 10F) of the present invention with reference to FIG. 8. The fifth embodiment is different from the foregoing first embodiment in that the conductor 16 is located in the hermetical cavity 46. For this reason, the following description is directed mainly to the features related to the conductor 16. Other features and advantages of the fifth embodiment which are like the corresponding features and advantages of the first embodiment will be mentioned by reference to the description of the first embodiment.

In the high-pressure discharge lamp 10F according to the present embodiment, the conductor 16 as a wire is wound around an outer peripheral of the pre-seal glass 38, while a second metal foil 68 formed of molybdenum and a second external lead pin 70 connected to one end of the second metal foil 68 and protruding externally of the one of the seal portions 28 are embedded in the fused portion between the one of the seal portions 28 and the external pin sheathing portion 44 of the pre-seal glass 38.

The high-pressure discharge lamp 10F according to the present embodiment is formed with a one-electrode structure in which the inert gas is in contact with the conductor 16 while the first metal foil 32 is isolated from the inert gas. As compared to the high-pressure discharge lamp 10 formed with the electrodeless structure, the high-pressure discharge lamp 10F formed with the one-electrode structure has a larger electrostatic capacity between the conductor 16 and the first metal foil 32, hence, a stronger electrostatic capacity therebetween. Thus, the starting voltage of discharge between the conductor 16 and the first metal foil 32 can be further lowered.

Since the conductor 16 is placed within the hermetical cavity 46 between the one of the seal portions 28 and the pre-seal glass 38, the conductor 16 does not protrude from the outer surface of the one of the seal portions 28. Therefore, in adjusting the focal point after the high-pressure discharge lamp 10F has been fitted on the reflector 66 having the access hole 64 for receiving the one of the seal portions 28 of the high-pressure discharge lamp 10F, nothing interferes with an internal surface of the access hole 64 as in the fourth embodiment. Thus, the focal point adjustment can be achieved easily.

While any one of the foregoing embodiments uses quartz glass for both of the envelope 12 and the pre-seal glass 38, the material forming the envelope 12 and the pre-seal glass 38 is not limited to quartz glass. For example, the pre-seal glass 38 may be formed from a high dielectric constant quartz glass comprising a mixture of titanium oxide or cerium oxide and quartz glass. In this case, the high-pressure discharge lamp has an increased electrostatic capacity between the conductor 16 and the metal foil 32, hence, a stronger electrostatic capacity therebetween. Thus, the starting voltage of discharge between the conductor 16 and the metal foil 32 can be further lowered.

Figure 9:
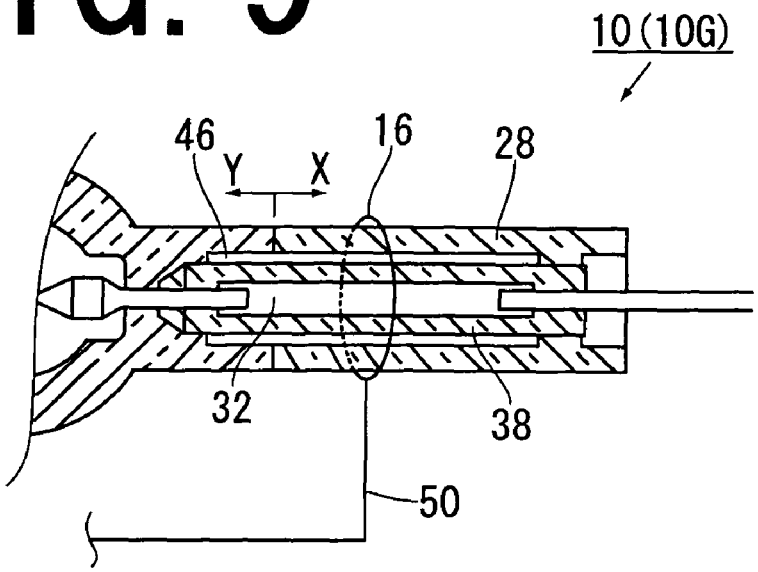
FIG. 9 is a view of a high-pressure discharge lamp in accordance with a sixth embodiment of the present invention.
Figure 10:
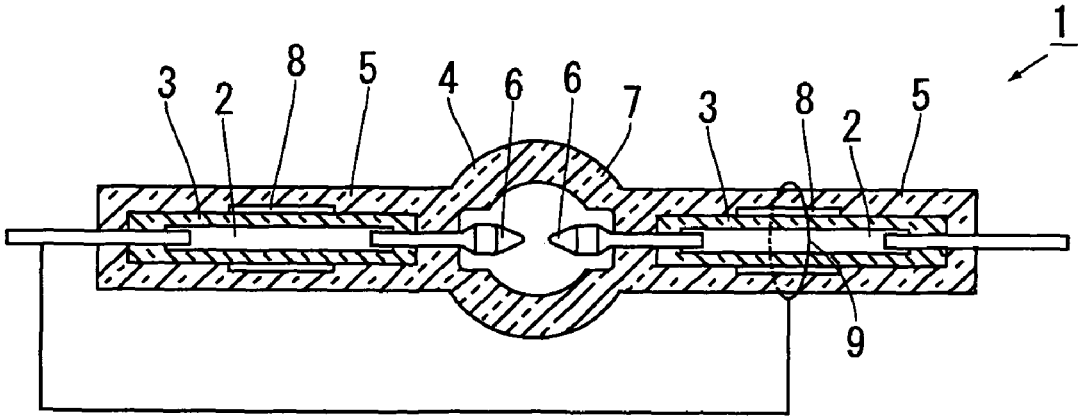
FIG. 10 is a view of a high-pressure discharge lamp in accordance with the conventional art.

Alternatively, a part of the one of the seal portions 28 of the envelope 12 may be formed from such a high dielectric constant quartz glass as shown in FIG. 9. In a high-pressure discharge lamp 10G according to a sixth embodiment shown in FIG. 9, an end portion (indicated as "X" in the figure) of the one of the seal portions 28 is formed from the above-described high dielectric constant quartz glass, while other portions (indicated at Y in the figure) including the rest of the one of the seal portions 28, the both of base portions 30 and the envelope 12 formed from common quartz glass. This arrangement enables to lower the starting voltage of discharge between the conductor 16 and the metal foil 32 as in the above-described case where the pre-seal glass 38 is formed from the high dielectric constant quartz glass. Generally, such a high dielectric constant quartz glass has the property of losing clarity or transparency due to crystallization when heated to a high temperature. However, the pre-seal glass 38 and the one of seal portions 28 are not required to be transparency and, hence, the use of the high dielectric constant quartz glass for the pre-seal glass 38 and the one of the seal portions 28 will not bring about any problem.

The envelope 12 and the pre-seal glass 38 are preferably formed from the same material because crack due to the difference in thermal expansion coefficient between different materials is unlikely at the fused interface between the envelope 12 and the pre-seal glass 38. However, the advantages of the present invention will result even if different materials are used to form the envelope 12 and the pre-seal glass 38 respectively.

While any one of the foregoing embodiments uses metal foils 32 of molybdenum and electrodes 34 of tungsten, the material of the metal foils 32 and that of the electrodes 34 are not limited to respective of molybdenum and tungsten but may be other materials.

While a conductive wire is used as the conductor 16, the conductor 16 may be in any other form than the conductive wire (for example a conductive piece) as long as discharge is generated between the conductor 16 and the metal foil 32.

While any one of the foregoing embodiments uses argon gas as the inert gas to be encapsulated in the hermetical cavity 46, any other inert gas may be used. Particularly when neon gas having a lower dielectric breakdown voltage than argon gas is mixed into the inert gas, the starting voltage of discharge between the conductor 16 and the metal foil 32 can be lowered. Mercury vapor can cooperate with the inert gas to exercise the Penning effect, thereby enables to lower the starting voltage of discharge. Accordingly, when mercury vapor is encapsulated in the hermetical cavity 46 together with the inert gas, it is possible to lower the starting voltage of discharge.

The high-pressure discharge lamp manufacturing procedure described above is only illustrative and, therefore, any other manufacturing procedure may be applied as long as the high-pressure discharge lamp 10 according to the present invention can be manufactured thereby.

While any one of the foregoing embodiments is directed to the high-pressure discharge lamp 10 adapted to a.c. lighting, a high-pressure discharge lamp adapted to d.c. lighting can be constructed according to the foregoing description of the high-pressure discharge lamp 10 adapted to a.c. lighting except that the tip of anode-side electrode has to be sized larger than the tip of cathode-side electrode.

While any one of the foregoing embodiments is directed to the high-pressure discharge lamp 10 has mounts 14 for both of the seal portions 28, the high-pressure discharge lamp 10 may provide the mount 14 for the one of the seal portions 28 and provide the metal foil 32, the electrode 34 and the external lead pin 36 to be embedded to the other seal portion 28 without the mount 14.

The disclosure of Japanese Patent Application No. 2007-140685 filed 28 May, 2007 including specification, drawings and claims is incorporated herein by reference in its entirety.

While only certain presently preferred embodiments of the present invention have been described in detail, as will be apparent for those skilled in the art, certain changes and modifications may be made in embodiments without departing from the spirit and scope of the present invention as defined by the following claims.

What is claimed is:

1. A high-pressure discharge lamp comprising:

a luminescent material;

an envelope including an arc tube portion having a first internal space in which the luminescent material is encapsulated, a pair of seal portions respectively extending from opposite ends of the arc tube portion and having second internal spaces, and a pair of base portions provided at borders of the seal portions for isolating the first internal space and the second internal spaces;

a mount inserted in the second internal space of one of the seal portions, the mount including a metal foil, an electrode having one end protruding into the first internal space and the other end connected to one end of the metal foil through one of the base portions, an external lead pin having one end connected to the other end of the metal foil and the other end protruding outside of the one of the seal portions, and a pre-seal glass embedded in the second internal space of the one of the seal portions, the pre-seal glass including a metal foil sheathing portion in which the metal foil is sheathed, an electrode sheathing portion sheathing a portion of the electrode extending from the one end of the metal foil toward the one of the base portions and fused to the one of the base portions, and an external lead pin sheathing portion sheathing a portion of the external lead pin extending outwardly from the other end of the metal foil and hermetically fused to an internal surface of the one of the seal portions, and a clearance defined between the metal foil sheathing portion and the one of the seal portions;

a conductor arranged around an outer periphery of the one of the seal portions for generating discharge between the conductor and the metal foil;

an inert gas encapsulated in the clearance hermetically sealed between the electrode sheathing portion and the external lead pin sheathing portion; and a metal piece arranged within the clearance.

2. The high-pressure discharge lamp according to claim 1, wherein the inert gas contains neon gas.

3. The high-pressure discharge lamp according to claim 1, further comprising mercury vapor encapsulated in the clearance.

4. The high-pressure discharge lamp according to claim 1, wherein the metal piece is a metal wire wound around an outer periphery of the pre-seal glass within the clearance.

5. The high-pressure discharge lamp according to claim 1, wherein the conductor is formed of a metal wire.

6. The high-pressure discharge lamp according to claim 1, wherein the conductor is formed of a conductive coat formed over an outer surface of the one of the seal portions.

7. The high-pressure discharge lamp according to claim 1, wherein the pre-seal glass includes a through hole for bringing the inert gas encapsulated in the clearance into contact with the metal foil.

8. The high-pressure discharge lamp according to claim 1, wherein the pre-seal glass is formed of a quartz glass having a high dielectric constant.

9. The high-pressure discharge lamp according to claim 1, wherein the one of the seal portions is formed of a quartz glass having a high dielectric constant.

10. A light source device comprising the high-pressure discharge lamp according to claim 1; and a high-frequency starter for applying a high voltage having a high frequency between the external lead pin and the conductor.

11. A high-pressure discharge lamp comprising:

a luminescent material;

an envelope including an arc tube portion having a first internal space in which the luminescent material is encapsulated, a pair of seal portions respectively extending from opposite ends of the arc tube portion and having second internal spaces, and a pair of base portions provided at borders of the seal portions for isolating the first internal space and the second internal spaces;

a mount inserted in the second internal space of one of the seal portions, the mount including a first metal foil, an electrode having one end protruding into the first internal space and the other end connected to one end of the first metal foil through one of the base portions, a first external lead pin having one end connected to the other end of the first metal foil and the other end protruding outside of the one of the seal portions, and a pre-seal glass embedded in the second internal space of the one of the seal portions, the pre-seal glass including a metal foil sheathing portion in which the first metal foil is sheathed, an electrode sheathing portion sheathing a portion of the electrode extending from the one end of the first metal foil toward the one of the base portions and fused to the one of the base portions, and an external lead pin sheathing portion sheathing a portion of the first external lead pin extending outwardly from the other end of the first metal foil and hermetically fused to an internal surface of the one of the seal portions, and a clearance defined between the metal foil sheathing portion and the one of the seal portions;

a conductor wound around an outer surface of the pre-seal glass within the clearance for generating discharge between the conductor and the first metal foil;

an inert gas encapsulated in the clearance hermetically sealed between the electrode sheathing portion and the external lead pin sheathing portion;

a second metal foil embedded in a fused portion between the one of the seal portions and the external pin sheathing portion, the second metal foil having one end connected to the conductor; and a second external lead pin having one end connected to the other end of the second metal foil and the other end protruding outside through the one of the seal portions.

12. A light source device comprising the high-pressure discharge lamp according to claim 11; and a high-frequency starter for applying a high voltage having a high frequency between the first external lead pin and the conductor.

* * * * *